US009296448B1

(12) United States Patent
Eatwell

(10) Patent No.: US 9,296,448 B1
(45) Date of Patent: Mar. 29, 2016

(54) COMBINED BACK SUPPORT AND BOARDING LADDER FOR AN INFLATABLE BOAT

(71) Applicant: Graham Paul Eatwell, Annapolis, MD (US)

(72) Inventor: Graham Paul Eatwell, Annapolis, MD (US)

( * ) Notice: Subject to any disclaimer, the term of this patent is extended or adjusted under 35 U.S.C. 154(b) by 0 days.

(21) Appl. No.: 14/499,295

(22) Filed: Sep. 29, 2014

(51) Int. Cl.

| | |
|---|---|
| ***B63B 17/00*** | (2006.01) |
| ***B63B 7/08*** | (2006.01) |
| ***B63B 27/14*** | (2006.01) |
| ***B63B 29/04*** | (2006.01) |

(52) U.S. Cl.
CPC ..... *B63B 7/085* (2013.01); *B63B 7/082* (2013.01); *B63B 27/14* (2013.01); *B63B 29/04* (2013.01); *B63B 2029/043* (2013.01)

(58) Field of Classification Search
USPC ..... 114/345, 362
IPC ..... B63B 7/082,27/14, 27/146, 7/085
See application file for complete search history.

(56) References Cited

U.S. PATENT DOCUMENTS

| | | | | |
|---|---|---|---|---|
| 4,130,316 | A * | 12/1978 | Rossi | A47C 12/02 182/156 |
| 4,572,330 | A | 2/1986 | Langevin | |
| 4,909,177 | A | 3/1990 | Jones | |
| 5,101,753 | A * | 4/1992 | Hull | B63B 7/085 114/345 |
| 5,154,134 | A | 10/1992 | Goldsmith | |
| 5,287,945 | A | 2/1994 | Thurlow | |
| 5,325,806 | A | 7/1994 | Lee | |
| 6,021,733 | A | 2/2000 | Jaramillo | |
| 6,145,621 | A | 11/2000 | Nye | |
| 6,651,776 | B2 | 11/2003 | Montecer | |
| 7,861,663 | B2 | 1/2011 | Sedlack | |
| 8,707,885 | B2 | 4/2014 | Nguyen | |

* cited by examiner

*Primary Examiner* — Stephen Avila

(57) ABSTRACT

An apparatus configurable as a back support and as a boarding ladder for use with an inflatable boat is disclosed. The apparatus includes a first frame configured for mounting on an inflated tube of the inflatable boat and a second frame, pivotally coupled to the first frame, the second frame having a transverse element. The second frame is moveable, with respect to the first frame, between a raised position, where the transverse element provides a back support, and a lowered position where the transverse element provides a rung of a boarding ladder. The apparatus may also include one or more third frames that extend below the second fame when the second frame is in the lowered position, the one or more third frames providing one or more additional rungs of the boarding ladder.

21 Claims, 13 Drawing Sheets

COMBINED BACK SUPPORT AND BOARDING LADDER FOR AN INFLATABLE BOAT

PRIORITY CLAIM

This application is a continuation-in-part of application Ser. No. 13/694,041, filed Oct. 23, 2012, and titled "Back Support for an Inflatable Boat", which is hereby incorporated herein.

BACKGROUND

Inflatable boats are characterized by one, or more, inflatable tubes, a floor and a transom. The inflated tubes provide much more buoyancy and stability than a rigid boat of a similar size.

Commonly, seats provided for inflatable boat are either transverse benches or forward facing seats. A disadvantage of a forward face seat is that the controls of an outboard motor are located behind the helmsman, where they are difficult to reach or see.

Passengers, in inflatable boats commonly sit either within the boat, on a bench seat, a frame supported seat or a central console, or else they sit on the side of the boat on one of the inflatable tubes (also called pontoons). The latter position is often preferred by the helmsman, especially when the inflatable boat is powered by an outboard motor with a tiller. In addition, seating within the boat is often limited, so some passengers sit on the tubes.

A disadvantage of sitting on the tube is that no back support is provided. Sitting, without back support, for an extended period of time is tiring. In addition, when sitting on a tube without a back support there is a risk that a person will lose their balance and fall out of the boat, especially when the boat is hit by a wave or wake or is subject to a harsh maneuver.

Further, statistics indicate that a majority of boating fatalities occur on boats smaller than 20 feet, often because the victim is unable to re-board the boat after falling overboard. Re-boarding without assistance can be very difficult when no boarding platform or boarding ladder is present. Thus, a small, portable boarding ladder is desirable.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
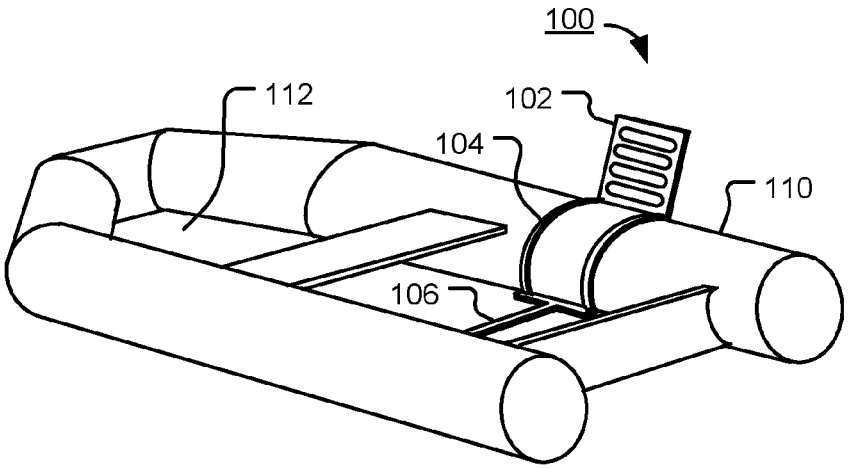
FIG. 1 is a diagram of an exemplary back support for an inflatable boat in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to the provision of back support in a small boat. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

The present disclosure relates to an apparatus for use on for an inflatable boat. Embodiments are disclosed where the apparatus provides a back support, a back support and a boarding step, and a back support and a boarding ladder. When used a back support, the apparatus provides increased comfort for a user and reduces the chance of the user falling out of the boat. When used a step, the apparatus enable a user to more easily board a boat from a dock or other boat. When used as a boarding ladder, the apparatus enables a user to more easily board the boat from the water.

FIG. 1 shows an example of a back support 100 for an inflatable boat in accordance with some embodiments of the invention. The boat may be fully inflatable, or it may be a rigid inflatable boat (RIB) with a rigid hull.

Although the description below is directed towards boats having inflatable tubes, the back support may be used in other boats having tube-shaped sides. Examples include boats with molded PVC sides, or foam filled fiberglass sides.

The back support 100 includes a support element 102, circum-tubular coupling elements 104, and a transverse brace 106.

Figure 2:
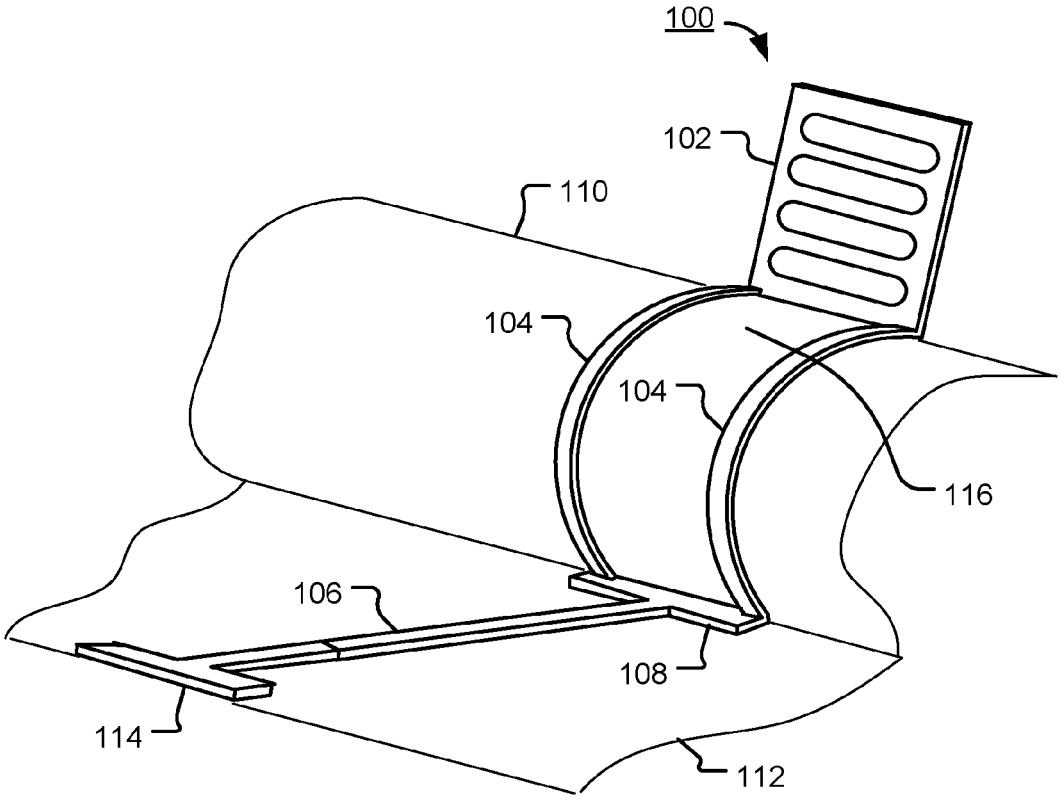
FIG. 2 is a more detailed view of the example back support shown in FIG. 1.

FIG. 2 is a more detailed view of the exemplary back support 100 shown in FIG. 1. Referring to FIG. 2, the circum-tubular coupling elements, 104, couple the support element 102 to the transverse brace 106 at, or close to, a first end 108 of the transverse brace 106. The transverse brace 106 provides one or more anchor points for the circum-tubular coupling elements 104. Alternative anchoring structures are described below and additional anchoring structures will be apparent to those of ordinary skill in the art.

In use, the first end 108 of the transverse brace 106 is positioned at the joint between an inflatable tube 110 of an inflatable boat and the floor 112. The transverse brace 106 spans the width of the floor 112. The second end 114 of the transverse brace 106 is positioned at the joint between the opposite inflatable tube and floor 112.

In one embodiment, the length of the transverse brace is adjustable. It may be adjustable only once (e.g. cut to fit) or adjustable multiple times. Various means for providing length adjustment in an elongated element are known to those of ordinary skill in the art. These include telescoping elements, pivoting elements, one or more scissor elements, screw elements, sliding elements, etc. Any of these means may be utilized in the present invention either separately or in combination.

In one embodiment, the length of the transverse brace is locked after adjustment. A number of locking mechanisms are known to those of ordinary skill in the art, including ratchets, cams, screws, pins, etc. In a further embodiment, the transverse brace is held in place by a spring force.

In one embodiment, the length of a transverse brace is fixed. In this embodiment the end 114 may be pivoted on the cross arm to enable the transverse brace to be rotated into position. The pivot may be locked once the end of the transverse brace is substantially perpendicular to the cross-arm of the transverse brace. The transverse brace may have a non-slip surface, such as a rubberized surface, to help to retain its position within the boat.

Figure 3:
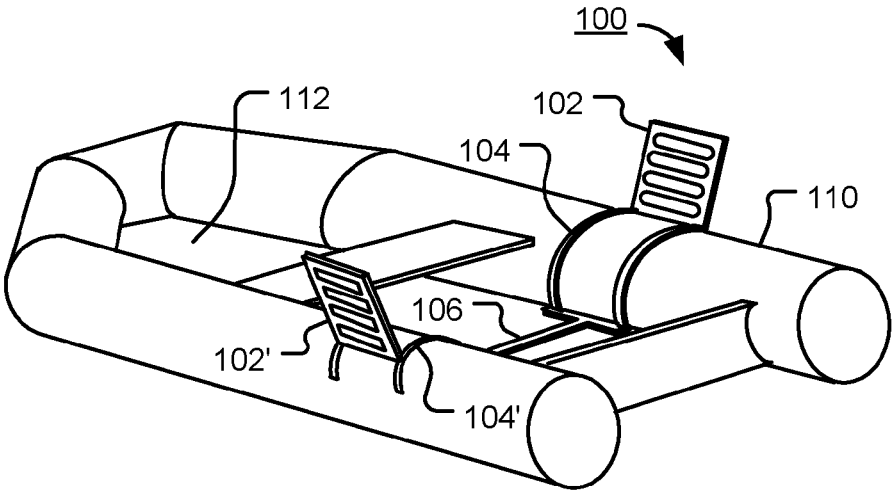
FIG. 3 shows an example of dual back supports for an inflatable boat in accordance with some embodiments of the invention.

FIG. 3 is an example of dual back supports for an inflatable boat in accordance with some embodiments of the invention. The arrangement shown in FIG. 3 has first support element 102, coupled to the transverse brace 106 by first circum-tubular coupling elements 104, and a second support element 102', coupled to the transverse brace 106 by second circum-tubular coupling elements 104'.

Buckling of the transverse brace is resisted by the stiffness of the brace or by pre-bending of the brace so that further bending is prevented by the floor of the boat.

The transverse brace 106 may have one, two or more cross arms.

The circum-tubular coupling elements 104 may be fixedly or removably coupled to the transverse brace 106 or may be formed integrally with the bracing element. In one embodiment, the circum-tubular coupling elements 104 are spaced apart horizontally in use, such that a user may sit on the region 116 of the inflatable tube 110 between the coupling elements 104.

The circum-tubular coupling elements 104 may be flexible to allow use with inflatable tubes of various diameters.

In one embodiment, the circum-tubular coupling elements 104 are sized for use with inflatable tubes within a specified range of diameters.

The support element 102 may be fixedly or removably coupled to the circum-tubular coupling element 104 or may be formed integrally with them.

In operation, user pressure against the support element 102 applies a rotational force to the circum-tubular coupling elements 104. Rotation of the circum-tubular coupling elements 104 is resisted by the transverse brace 106.

Figure 4:
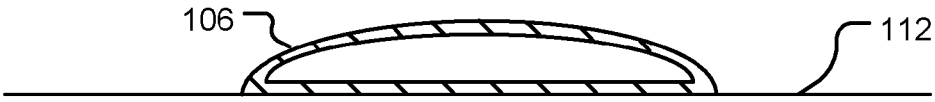
FIG. 4 is a cross-sectional view of a transverse brace in accordance with some embodiments of the invention.

FIG. 4 is a cross-sectional view of an exemplary transverse brace 106 in accordance with some embodiments of the invention. In the embodiment shown in FIG. 4, the top side of the brace 106 has a curved profile to reduce the chance of a user tripping on the brace when moving about the boat. The curvature also increases the rigidity of the brace. Other cross-sectional profiles may be used. The underside of the transverse brace may be coated with a non-slip material.

Figure 5:
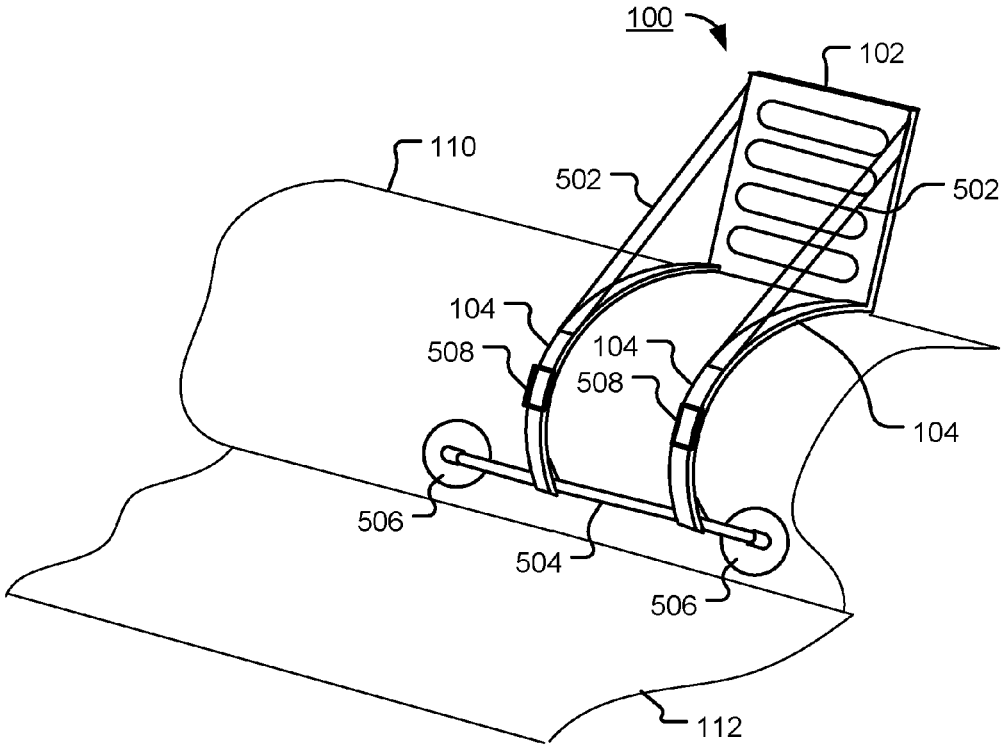
FIG. 5 is a further exemplary back support for an inflatable boat with glued-on anchor pads in accordance with some embodiments of the invention.

FIG. 5 is a further example of a back support 100 for an inflatable boat in accordance with some embodiments of the invention. In this embodiment, the support element 102 is held by circum-tubular couplers 104 and by straps 502. The straps and couplers are connected to a bar 504 that, in turn, is coupled to the inflatable tube 110 with glued-on anchor pads 506. The length of the straps may be adjusted using buckles 508, for example. This enables the angle of the back support to be adjusted. A single strap that passes around the back of the back support may be used. Alternatively, two separate straps may be used. Use of bar 504 allows the fore-aft position of the back support to be adjusted.

Figure 6:
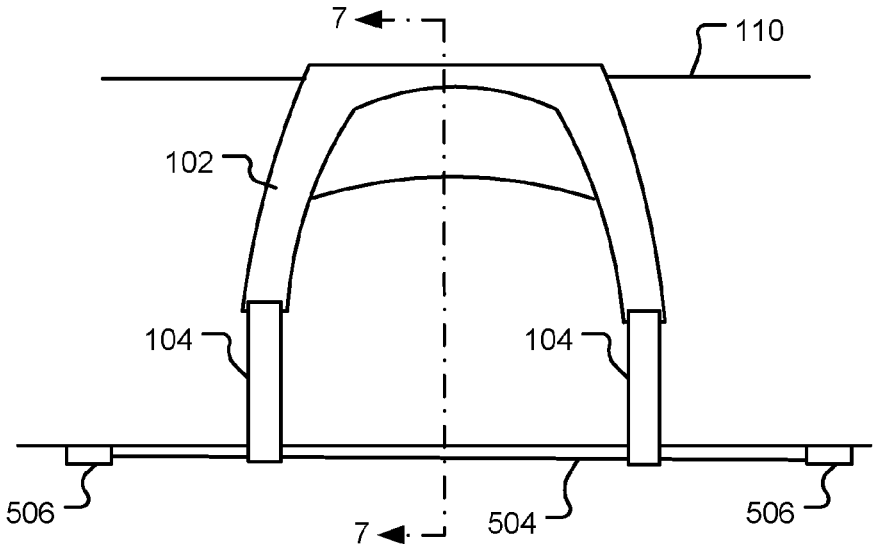
FIG. 6 is an exemplary molded back support for an inflatable boat in accordance with some embodiments of the invention.

FIG. 6 is an exemplary molded back support for an inflatable boat in accordance with some embodiments of the invention. In this embodiment the support element 102 is attached via circum-tubular coupling elements 104 to a bar 504. The bar is attached to the tube via glue-on anchor pads 506. The lower surface of the support element 102 is curved to match the curvature of the inflatable tube 110. The support element may be constructed of a hollow plastic material, a solid plastic material, foam, or other material. It may be formed by molding, or by other manufacturing techniques.

Figure 7:
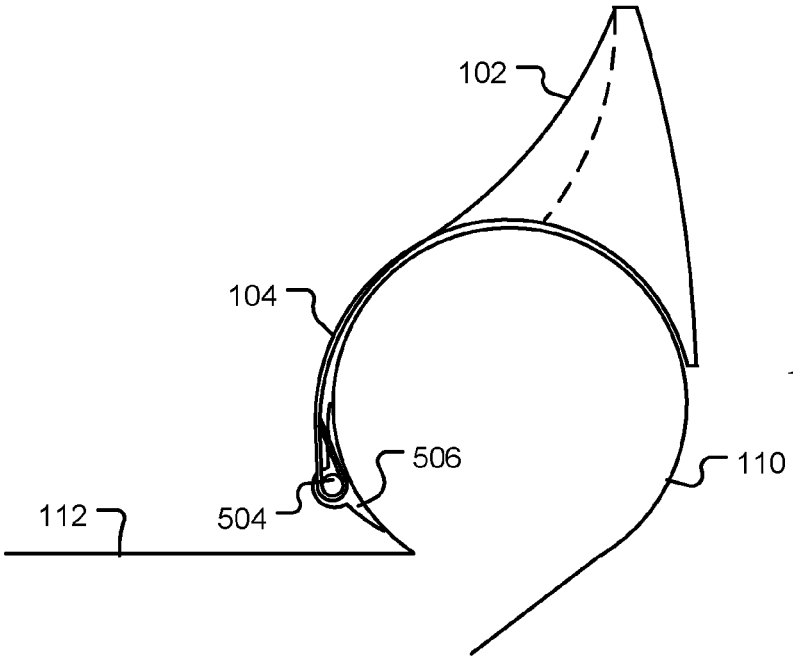
FIG. 7 is a side view of the back support shown in FIG. 6.

FIG. 7 is a side view of the back support shown in FIG. 6. The circum-tubular straps 104 may be attached to the support element by various means, or may be integral with the support element. The support element 102 may be constructed of buoyant foam material and may be detachable to provide a floatation aid.

Figure 8:
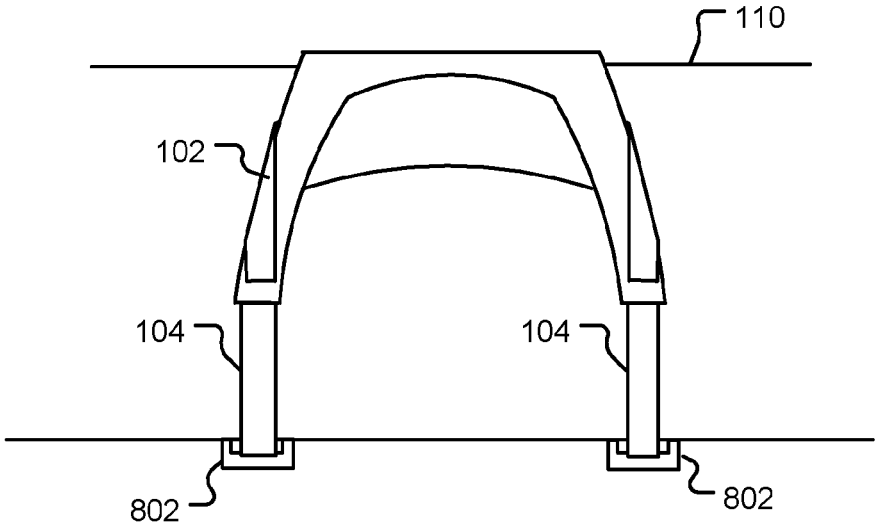
FIG. 8 is an exemplary molded back support with a continuous strap in accordance with some embodiments of the invention.

FIG. 8 is an exemplary molded back support with a continuous strap in accordance with some embodiments of the invention. In this embodiment, the support element 102 is held in place on the tube 110 by a single strap 104, such as a woven strap, that passes around the rear of the support element. The strap is attached to anchor pads 802.

Figure 9:
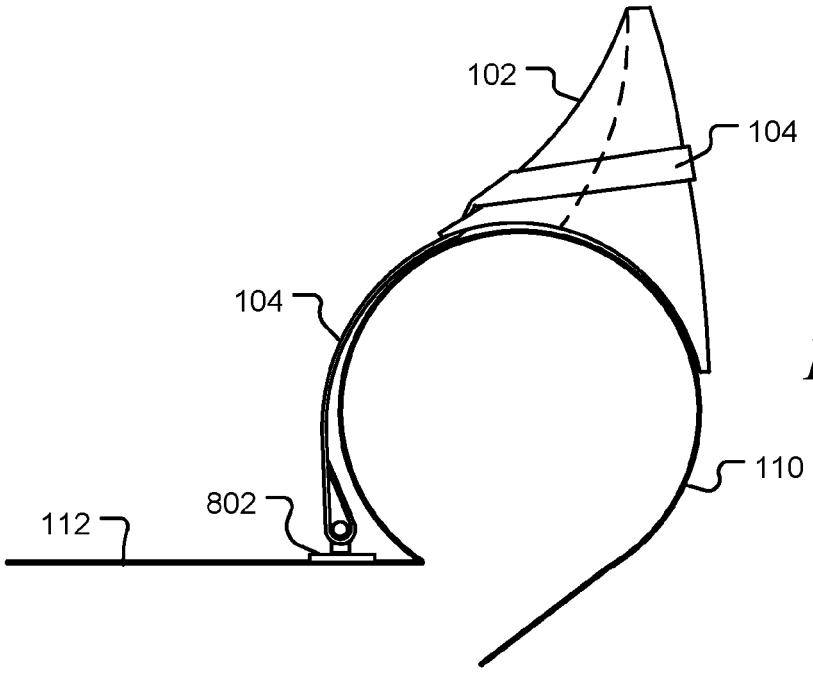
FIG. 9 is a side view of the back support shown in FIG. 8.

FIG. 9 is a side view of the back support shown in FIG. 8. In this embodiment, the anchor pads 802 are attached to the floor 112 of the boat, and the strap ends are attached directly to the anchor pads, rather than to a bar. Other forms of attachment may be used.

Figure 10:
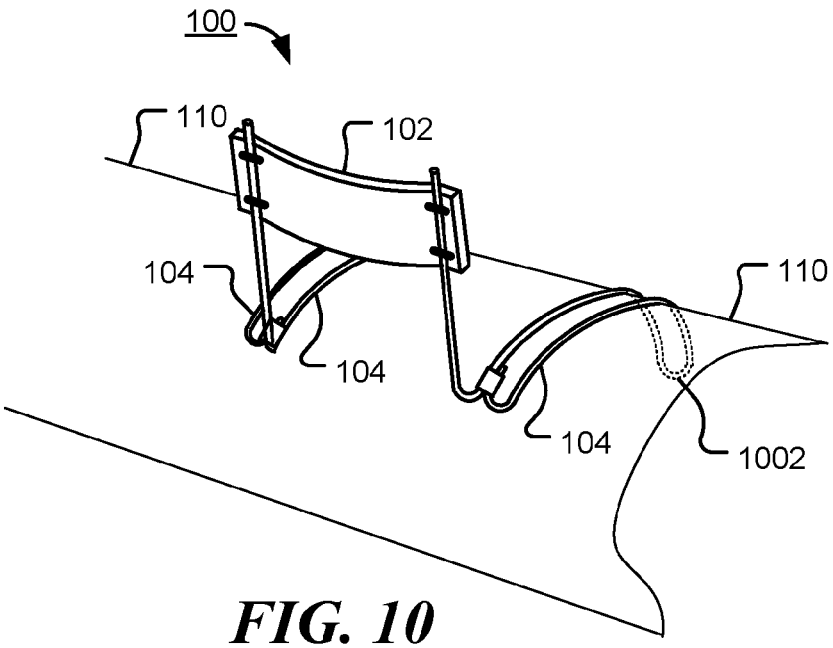
FIG. 10 is an exemplary back support with a rod or tubular frame in accordance with some embodiments of the invention.

FIG. 10 is an exemplary back support 100 with a rod or tubular frame in accordance with some embodiments of the invention. Referring to FIG. 10, the support element 102 is mounted on frames 104. The frames may be constructed from metal rods or tubes, for example. Aluminum, stainless steel, or other corrosion resistant materials may be used. The frames 104 are circum-tubular coupling elements, and may be attached, at ends 1002, to anchor points on the inside of the tube 110 or on the boat floor. The frames are curved to match the profile of the tube. In the embodiment shown in FIG. 10, the curved portion of the frame is doubled-back to distribute the forces applied to the tube 110. Other means to distribute the forces across the surface of the tube may be used, such as a larger diameter frame or rigid attachments. The frames 104 may be removably attached to the support element 102 to allow for compact storage.

Figure 11:
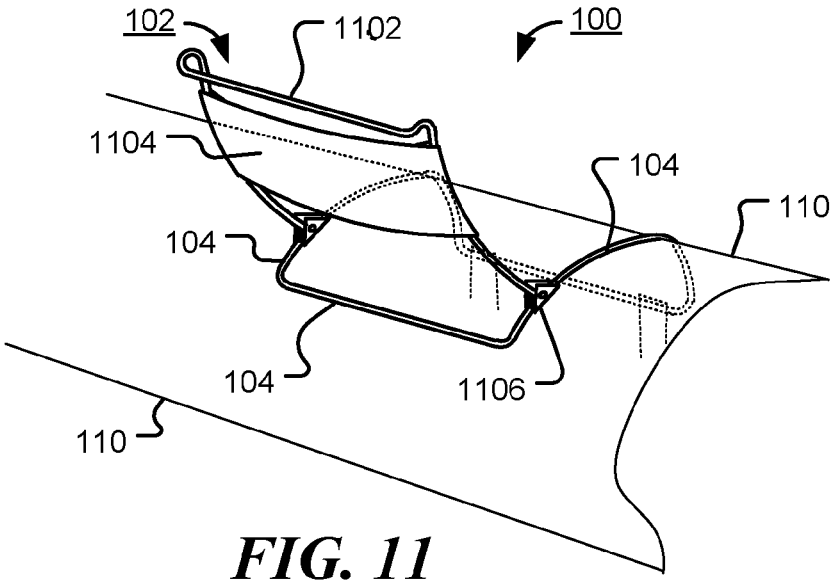
FIG. 11 is a further exemplary back support with a rod or tubular frame in accordance with some embodiments of the invention.

FIG. 11 is a further exemplary back support with a rod or tubular frame in accordance with some embodiments of the invention. In this embodiment, the circum-tubular coupling element is implemented as a first frame 104. The support element 102 comprises a second frame 1102 that supports a transverse element 1104. The transverse element 1104 may be a flexible material, such as cloth or mesh, or a more rigid material such as a plastic, for example. The second frame 1104 is coupled to the first frame 104 at hinges 1106. In one embodiment, the vertical sides of the second frame have the same curvature as the coupling element 104. This enables the second frame 1102 to be folded inwards onto the first frame 104. This allows compact storage and facilitates easier boarding and disembarkation. The inboard edge of the circum-tubular coupling element 104 may be attached to anchor points either directly or via straps, for example.

Figure 12:
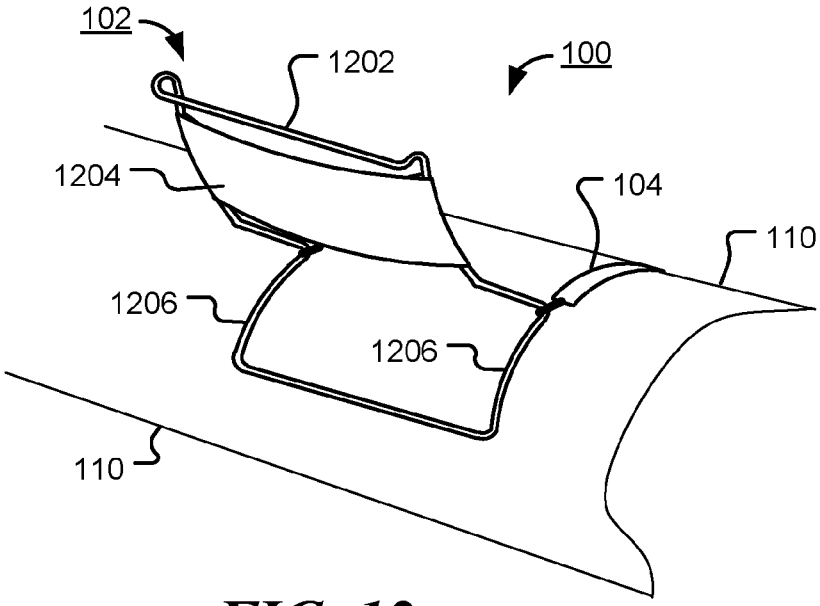
FIG. 12 is a still further exemplary back support with a rod or tubular frame in accordance with some embodiments of the invention.

FIG. 12 is a still further exemplary back support with a rod or tubular frame in accordance with some embodiments of the invention. In the embodiment shown in FIG. 12, the support element 102 comprises a frame 1202, and transverse element 1204. The side portions 1206 of the frame 1202 are curved to match the curvature of the inflated tube 110. The upper portion of the frame 1202 may be hinged to the lower portion 1206 to enable the upper portion to be folded inwards when not in use. The support element 102 is coupled to the interior of the boat via circum-tubular coupling element 104 that may be a flexible strap or webbing, for example. Alternatively, the flexible strap 104 may be glued to the inflated tube 110. A pad may be used in place of the strap, but the strap distributes the load across a greater area of the tube 110.

Figure 13:
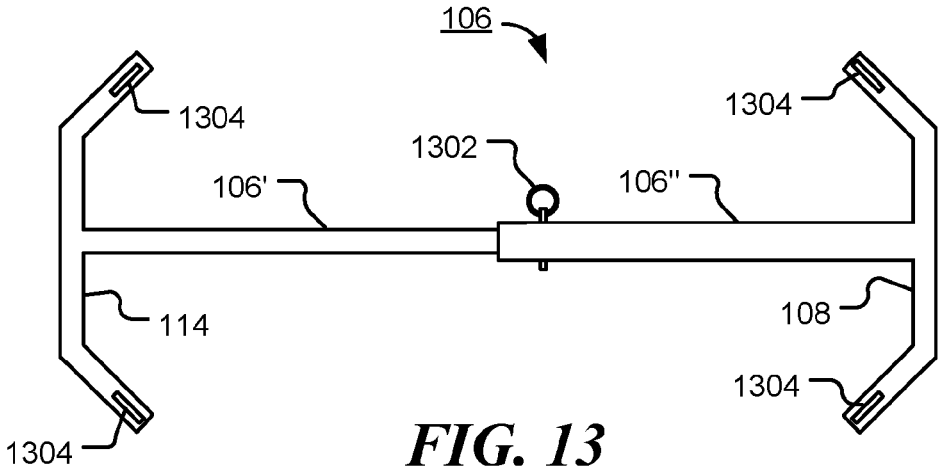
FIG. 13 is a diagram of an exemplary transverse brace, in accordance with certain embodiments of the present invention.

FIG. 13 is a diagram of an exemplary transverse brace 106, in accordance with certain embodiments of the present invention. Referring to FIG. 13, the transverse brace 106 has a first portion 106' and a second portion 106". In one embodiment, the first portion 106' slides inside of the second portion 106" and is locked in place by pin 1302. In a further embodiment, the first portion 106' is hinged to the second portion 106" and is locked in place by pin 1302. The pin 1302 may be a quick release pin to enable the transverse brace 106 to be easily removed and installed. The first end 108 and second end 114 support anchor points 1304. The anchor points 1304 may be loops for attaching straps or fasteners, holes for receiving fasteners, or simply regions of the brace to which fasteners such as clamps may be attached.

The transverse brace 106 may be used to provide anchor points for one or more back supports. The transverse brace 106 may also be used to provide support for other items including, but not limited to, storage containers, life lines, oars etc. The transverse brace may also provide support for vertical members that, in turn, support shade elements (such as a bimini top or a parasol) or grab rails. Multiple transverse braces may be used in conjunction to provide increased support.

Figure 14:
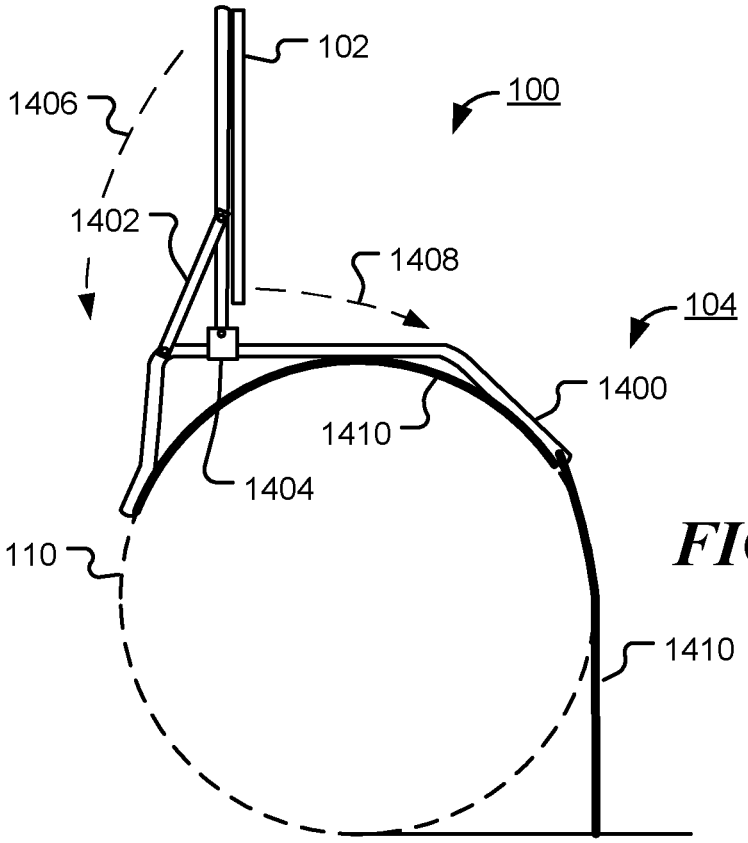
FIGS. 14 and 15 show a foldable back support, in accordance with certain embodiments of the present invention.
Figure 15:
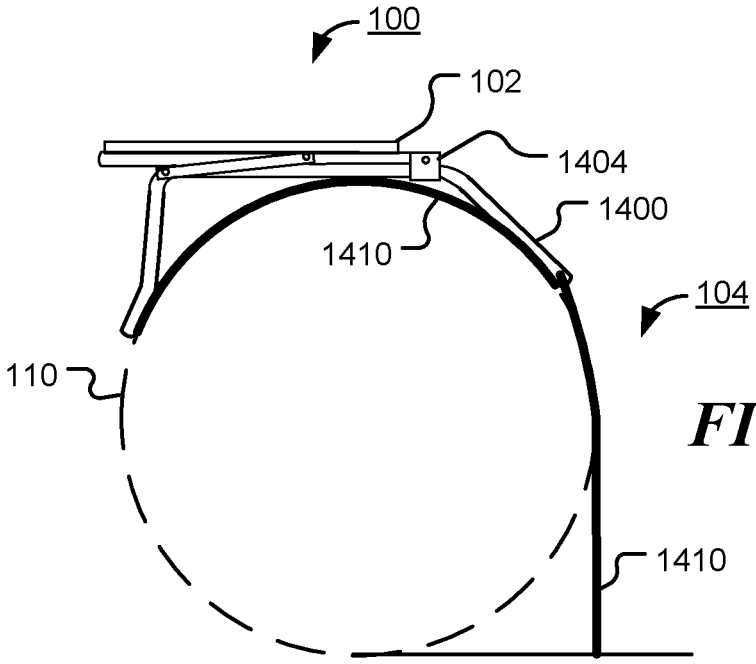

FIGS. 14 and 15 show a foldable back support 100, in accordance with certain embodiments of the present invention. In FIG. 14 the support element 102 is mounted on a frame 1400 and coupled to frame 1400 via a strut 1402 and a slidable member 1404. The strut 1402 is rotatably coupled to the frame 1440 at one end and to the support element 102 at the other end, using a pin, for example. The circum-tubular coupling element 104 comprises frame 1400 and strap 1410. The slidable member 1402 may be locked in position using removable pin, for example. When the pin is removed, the support element 102 may folded outward, with respect to the inflatable boat, in the direction of arrow 1406, while the slidable member 1404 slides in the direction of arrow 1408 on the frame 1400 to the configuration shown in FIG. 15. In FIG. 15, the support element 102 is substantially horizontal and provides a substantially horizontal surface that may be used as a seat, or as a step for boarding or disembarking. In the horizontal configuration, the support element 102 does not impede boarding or disembarkation. In this embodiment, the circum-tubular coupling elements 104 also include straps that couple the frame 1400 portion to the interior of the boat. The frame 1400 may be constructed of stainless steel tube, aluminum tube or other material and is shaped to match the curvature of the inflated tube 110.

The support element 102 is operable to support the back of a user seated on an inflated tube of the inflatable boat. The circum-tubular coupling element 104, comprising frame 1400 and one or more straps 1410, is operable to couple the support element 102 to at least one anchor point within the inflatable boat. In operation, the at least one circum-tubular coupling element 104 prevents outward rotation of the support element about the inflated tube.

Figure 16:
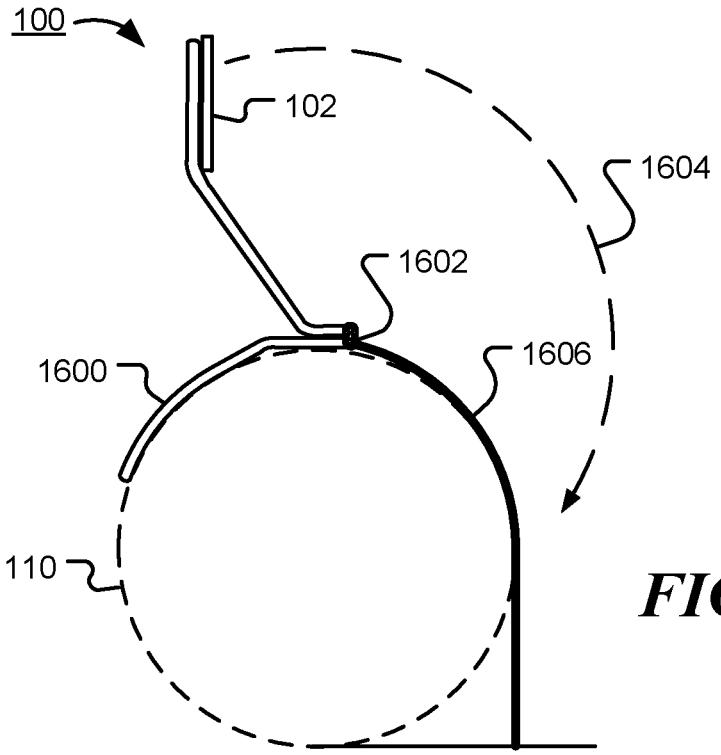
FIGS. 16 and 17 show a further foldable back support, in accordance with certain embodiments of the present invention.
Figure 17:
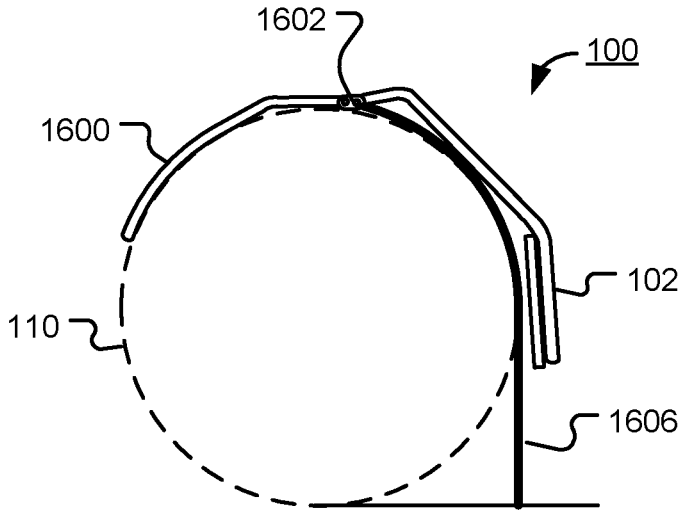

FIGS. 16 and 17 show a further foldable back support 100, in accordance with certain embodiments of the present invention. In FIG. 16, the support element 102 is hinged to frame 1600 at hinge 1602, enabling the back rest to be folded inwards, with respect to the inflatable boat, in the direction of arrow 1604. The folded back support is shown in FIG. 17. In the folded position, the support element 102 does not impede embarkation and disembarkation. The frame portion of support element 102 may comprise angled sections, as shown in FIG. 16, or may be curved to follow the contour of the tube 110. In this embodiment, the circum-tubular coupling elements comprise frame 1600 and straps 1606 that couple the frame to the interior of the boat. The frame 1600 is shaped to match the curvature of the inflated tube 110.

Figure 18:
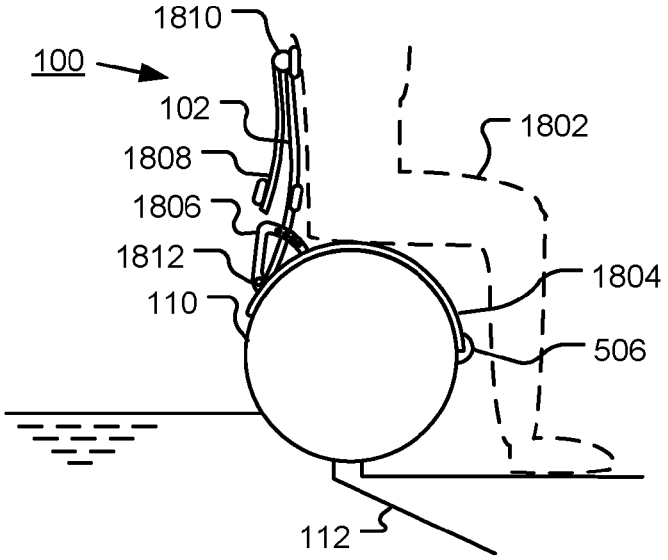
FIGS. 18-21 are diagrammatic representations of an apparatus for providing a back support and a boarding ladder for use with an inflatable boat, in accordance with certain embodiments of the present invention.

FIG. 18 is a diagrammatic representation of an apparatus 100 for providing a back support and boarding ladder for use with an inflatable boat 112, in accordance with further embodiments of the disclosure. In FIG. 18, the apparatus 100 is positioned to provide a back support for a user 1802, enabling the user to sit comfortably and safely on the inflated tube 110. The apparatus includes a first frame 1804, shaped to rest on and be supported by an inflated tube 110 of the inflatable boat 112 such that at least a portion of the first frame contacts an upper exterior surface of the inflated tube 110. The first frame is configured to couple to the inflatable boat 112 at an anchor point 506 to prevent rotation of the first frame 1804 about the inflated tube 110. Other means of anchoring may be provided, as described above for example. For example, an adjustable length transverse brace operable to span the width of an inflatable boat between the first and second sections of inflated tube of the inflatable boat may be used to provide one or more anchor points for the combined back rest and boarding ladder. The transverse brace, an exemplary embodiment of which is shown in FIG. 13 for example, includes a first section 106' and a second section 106" adjustable coupled to the first section, such that the combined length of the first and second sections spans the width of the inflatable boat. At least one anchor point 1304 is attached to the first section, and in operation, the at least one anchor point is located in proximity to a section of tube where the combined back rest and boarding ladder is to be located, as shown in FIG. 2, for example.

Referring again to FIG. 18, the apparatus 100 includes a second frame 102 that, in a first mode of operation, is supported in a raised position, as shown, by retaining mechanism 1806. In the raised position, the second frame provides a back support for a user 1802. The apparatus also includes one or more third frames 1808. The second frame is pivotally coupled to the first frame at coupling 1812. In a further embodiment, the second frame may be slideably coupled to the first frame.

Figure 19:
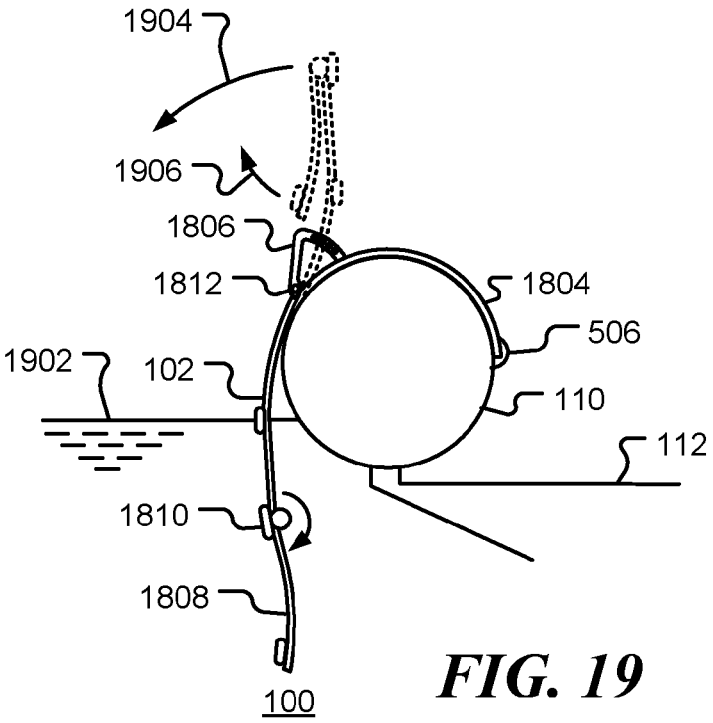

FIG. 19 is a further diagrammatic representation of the apparatus 100 shown in FIG. 18. In FIG. 19, the apparatus 100 is positioned to provide a boarding ladder. The back support position is shown by the broken line for reference. The second frame 102 is pivotally coupled the first frame 1804, enabling it to be swung down, as indicated by arrow 1904, to form an upper section of a boarding ladder. The one or more third frames 1808 extend below the second frame to provide one or more lower sections of the boarding ladder. In this embodiment, a single third frame is shown pivotally coupled to the second frame. The third frame 1808 extends by pivoting in the direction of arrow 1906 relative to the second frame. In other embodiments, the one or more third frames may extend from the second frame in a telescoping manner as is known for conventional boarding ladders. In operation, the lower sections of the ladder are below the surface 1902 of the water in which the boat 112 floats. When positioned to provide a boarding ladder, transverse elements of the second and third frames provide rungs of the boarding ladder. When positioned to provide a back support for the user, one or more transverse elements of the second frame provide a support for the user's back.

The second frame is pivotally coupled to the first frame at coupling 1812. This enables the second frame to be moveable between a raised position, where it provides a back support as shown in FIG. 18, and a lowered position where second frame provide an upper section of a boarding ladder, as shown in FIG. 19.

Figure 20:
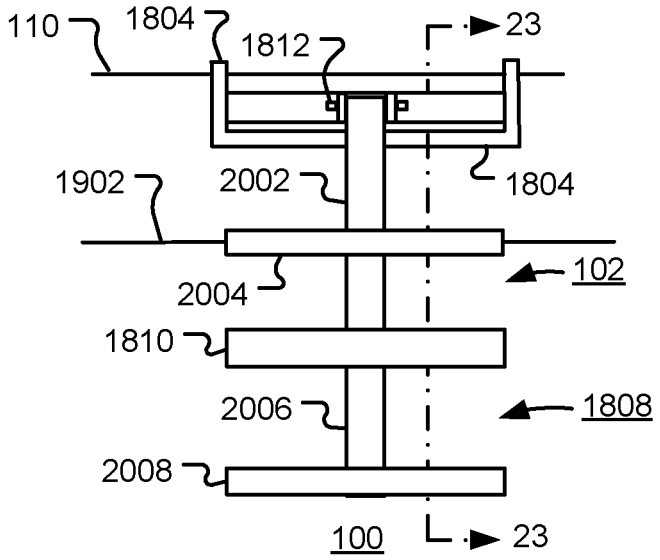

FIG. 20 is a diagrammatic view of a combined back support and boarding ladder in accordance with embodiments of the disclosure. The apparatus 100 is viewed from the side of the inflatable tube 110. The apparatus is shown in a lowered position where it is usable as a boarding ladder. The third frame 1808 extends below the surface 1902 of the water in which the boat floats. The second frame 102 is pivotally coupled to the first frame at coupling 1812. The second frame 102 includes first support member 2002 having first and second end portions. The first end portion is pivotally coupled to the first frame 1804, via coupling 1812, to allow motion of the first support member in a vertical plane. The second frame 102 also includes a transverse element 1810 coupled to the second end portion of the first support member 2002 of the second frame 102. Optionally, the second frame 102 may include one or more additional transverse elements 2004 to provide additional rungs for the boarding ladder. A single third frame 1808 is shown that includes a first support member 2006 having first and second end portions, the first end portion configured to couple to the support member 2002 of the second frame. The third frame 1808 also includes a transverse element 2008 coupled to the second end portion of the first support member 2006 of the third frame 1808 at the second end portion of the first support member 2006.

The transverse element 2004 may be curved and/or padded to provide a comfortable back support. The transverse elements 1810, 2004 and 2008 may be covered with a no-slip material to facilitate safe boarding.

The first, second and third frames may constructed of corrosion-resistant materials such as stainless steel, aluminum fiberglass, carbon fiber, or plastics, or a combination thereof. Other materials may be used.

Figure 21:
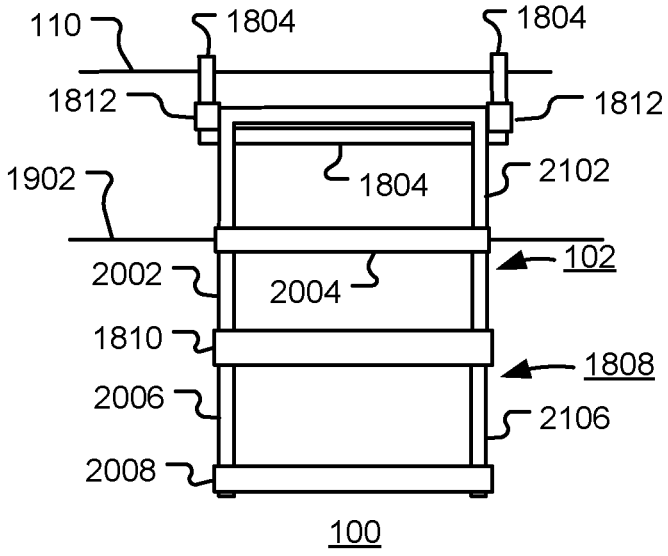

FIG. 21 is a further diagrammatic view of a combined back support and boarding ladder in accordance with embodiments of the disclosure. Again, the apparatus 100 is shown in a lowered position where it is usable as a boarding ladder. In the embodiment shown in FIG. 21, the second frame 102 includes first support member 2002 and second support member 2102. The first and second support members provide side rails to which the transverse elements 1810 and 2004 are attached. The third frame includes first support member 2006 and second support member 2106. The first and second support members provide side rails to which the transverse element 2008 is attached. The second frame 102 is pivotally coupled to the first frame at coupling 1812. The second frame 102 includes a first support member 2002 and second support member 2102, each having first and second end portions. The first end portions are pivotally coupled to the first frame, via coupling 1812, to allow motion of the first support member in a vertical plane. The second frame 102 also includes a transverse element 1810 coupled to the second end portion of the first support member 2002 and second support members 2102 of the second frame 102. Optionally, the second frame 102 may include one or more additional transverse elements 2004 to provide additional rungs for the boarding ladder. A single third frame 1808 is shown that includes a first support member 2006 and a second support member 2106, each having first and second end portions, the first end portions configured to couple to the support members 2002 and 2106, respectively, of the second frame. The third frame 1808 also includes a transverse element 2008 coupled to the second end portion of the first and second support members 2006 and 2106 of the third frame 1808 at the second end portions of the first and second support members.

Figure 22:
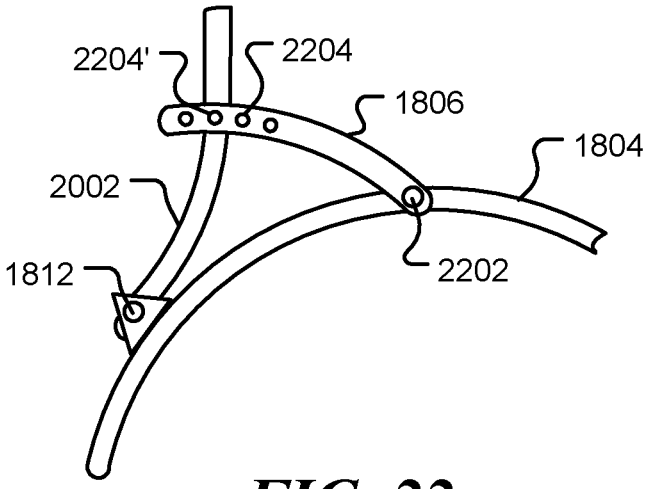
FIGS. 22-24 are diagrammatic representations of a retaining mechanism for a combined back support and boarding ladder for use with an inflatable boat, in accordance with certain embodiments of the present invention.

FIG. 22 is a diagrammatic view of a combined back support and boarding ladder, in accordance with embodiments of the disclosure, showing an exemplary retaining mechanism 1806. In the embodiment shown, the retaining mechanism comprises an arm 1806. The arm may be curved to match the curvature of the first frame 1804. One end portion of the arm 1806 is pivotally coupled to the first frame 1804 at coupling 2202, while the other end portion contains a series of holes 2204. At each of a number of raised positions, a corresponding hole in the support member 2002 of the second frame aligns with a hole 2204' allowing a pin, or other fastener, to be inserted to hold the support member 2002 in the desired raised position. A single hole 2204 may be used, or a series of holes may be used to enable the angle of the back rest to adjusted to a desired position. The support member 2002 is pivotally coupled to the first frame at coupling 1812. When two support members are used, as shown in FIG. 21, for example, a second arm 1806 may be used for the second support member.

Figure 23:
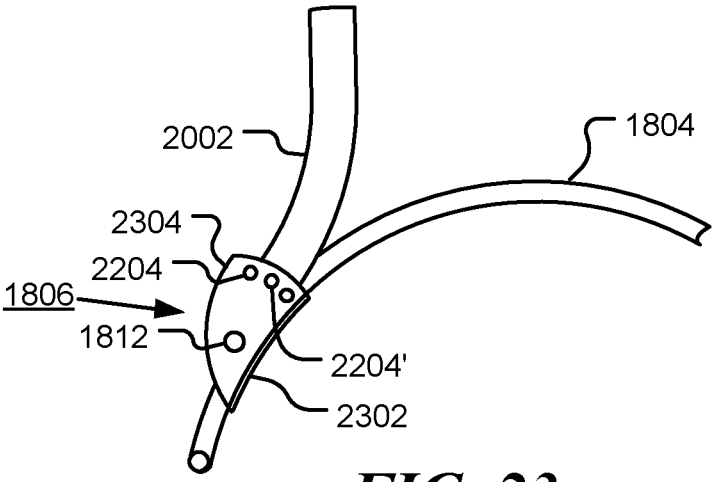

FIG. 23 is a sectional view of a combined back support and boarding ladder in accordance with embodiments of the disclosure showing a further exemplary retaining mechanism 1806. The view is taken through section 23-23 shown in FIG. 20. In the embodiment shown, the retaining mechanism comprises a first element 2302 that extends transversely between the sides of the first frame 1804. A second element 2304 is attached to the first element and supports pivot coupling 1812 that couples to the support member 2002 of the second frame. The second element 2304 is oriented perpendicular to the first element 2302. The second element 2304 contains a series of holes 2204. At each of a number of raised positions, a corresponding hole in the support member 2002 of the second frame aligns with a hole 2204' allowing a pin, or other fastener, to be inserted to hold the support member in the desired raised position. A single hole 2204 may be used, or a series of holes may be used to enable the angle of the back rest to adjusted to a desired position. The support member 2002 is pivotally coupled to the first frame at coupling 1812. The embodiment may be used, for example, when the second frame has a single support member, as shown in FIG. 20, for example.

Figure 24:
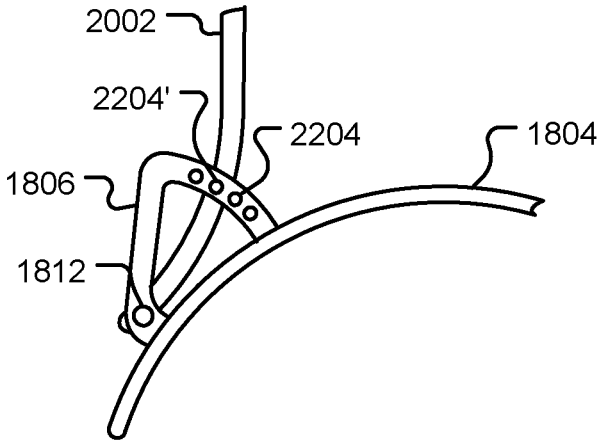

FIG. 24 is a diagrammatic view of a combined back support and boarding ladder in accordance with embodiments of the disclosure showing a further exemplary retaining mechanism 1806. In the embodiment shown, the retaining mechanism comprises a bracket 1806 coupled to the first frame 1804. One arm of the bracket 1806 contains a series of holes 2204. At each of a number of raised positions, a corresponding hole in the support member 2002 of the second frame aligns with a hole 2204' allowing a pin, or other fastener, to be inserted to hold the support member in the desired raised position. A single hole 2204 may be used, or a series of holes may be used to enable the angle of the back rest to adjusted to a desired position. The support member 2002 is pivotally coupled to the first frame at coupling 1812. One retaining mechanism 1806 is used for each support member of the second frame. When two support members are used, as shown in FIG. 21 for example, the two brackets provide convenient handholds when using the boarding ladder.

Other retaining mechanism will be apparent to those of ordinary skill in the art. For example, a racket mechanism as used in folding chairs may be used.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as critical, required, or essential features or elements of any or all the claims.

What is claimed is:

1. An apparatus for providing a back support and a boarding ladder for use with an inflatable boat, the apparatus comprising:

a first frame, shaped to rest on and be supported by an inflated tube of the inflatable boat such that at least a portion of the first frame contacts an upper exterior surface of the inflated tube, the first frame configured to couple to the inflatable boat at an anchor point;

a second frame comprising:

a first support member having first and second end portions, the first end portion pivotally coupled to the first frame to allow motion of the first support member in a vertical plane; and a first transverse element coupled to the second end portion of the first support member of the second frame;

a third frame comprising:

a first support member having first and second end portions, the first end portion of the third frame configured to couple to the second end portion of the second frame; and a transverse element coupled to the second end portion of the first support member of the third frame; and a retaining mechanism for holding the second frame in a raised position such that the first transverse element of the second frame is located above the first frame and provides a back support for a person seated on the inflated tube of the inflatable boat, where the second frame is moveable between the raised position and a lowered position in which the transverse element is located below the first frame and provides a first rung of a boarding ladder and the third frame is located below, and supported by, the second frame such that the transverse element of the third frame provides a second rung of the boarding ladder.

2. The apparatus of claim 1, where the second frame further comprises a second support member having first and second end portions, the first end portion pivotally coupled to the first frame to allow motion of the second support member in a vertical plane, where the first and second support members comprise side rails and the first transverse element of the second frame couples between the first and second support members of the second frame.

3. The apparatus of claim 1, where the third frame further comprises a second support member, where the first and second support members of the third frame comprise side rails and the transverse element of the third frame couples between the first and second support members.

4. The apparatus of claim 1, further comprising one or more additional third frames configured to provide additional lower sections of the boarding ladder when the second frame is in the lowered position.

5. The apparatus of claim 1, where the third frame is pivotally coupled to the second frame.

6. The apparatus of claim 1, where the first support member of the third frame extends from within the second frame in a telescoping action.

7. The apparatus of claim 1, where the second frame further comprises a second transverse element configured to provide an additional rung of the boarding ladder when the second frame is in the lowered position.

8. The apparatus of claim 1, where the first support structure of the second frame is located in proximity to the middle of first transverse element.

9. The apparatus of claim 1, where the first transverse element of the second frame is padded.

10. The apparatus of claim 1, where the first transverse element of the second frame is curved.

11. The apparatus of claim 1, where the retaining mechanism comprises first and second brackets, attached to and extending from opposite sides of the first frame, the brackets configured to provide handholds when the second frame is in the lowered position.

12. The apparatus of claim 11, where an arm of the first bracket contains one or more holes that align with a corresponding hole in the first support element of the second frame when the second frame is in the raised position, the one or more holes configured to receive a fastener to retain the second frame in a raised position.

13. The apparatus of claim 1, where the transverse elements of the second and third frames are covered with a non-slip material.

14. The apparatus of claim 1, where the inflated tube comprises a first section on one side of the inflatable boat and a second section on an opposite side of the inflatable boat, the apparatus further comprising:

a transverse brace having at least one anchor point, operable to span the width of the inflatable boat between the first and second sections of the inflated tube, where transverse brace provides the anchor point for the first frame.

15. An apparatus configurable as a back support and as a boarding ladder for use with an inflatable boat, the apparatus comprising:

a first frame configured for mounting on an inflated tube of the inflatable boat; and a second frame, moveably coupled to the first frame, the second frame having at least one transverse element, where the second frame is moveable, with respect to the first frame, between a raised position, where the at least one transverse element provides a back support, and a lowered position where the at least one transverse element provides at least one rung of a boarding ladder, where the first frame has sides that are curved to match the circum-tubular curvature of the inflated tube of the inflatable boat.

16. The apparatus of claim 15, further comprising one or more third frames that extend below the second fame when the second frame is in the lowered position, the one or more third frames providing one or more additional rungs of the boarding ladder.

17. The apparatus of claim 16, where a third frame of the one or more third frames is pivotally coupled to the second frame.

18. The apparatus of claim 16, where a third frame of the one or more third frames extends from the second frame in a telescoping action, such that the distance is increased between a rung provided by a third frame of the one or more third frames and the transverse element of the second frame.

19. The apparatus of claim 15, further comprising one or more anchor pads configured to couple the first frame to the inflatable boat.

20. An adjustable length transverse brace operable to span the width of a floor of an inflatable boat between first and second sections of an inflated tube of the inflatable boat to provide one or more anchor points for a combined back rest and boarding ladder, the transverse brace comprising:

a first transverse member having a first end section perpendicular to the first transverse member and sized for positioning at a joint between the first section of the inflatable tube and a floor of the inflatable boat;

a second transverse member adjustably coupled to the first member and having a second end section for positioning at a joint between the second section of the inflated tube and the floor of the inflatable boat, such that the combined length of the first and second section transverse members spans the width of the floor of the inflatable boat and the transverse brace is held in compression between the first and second sections of the inflated tube; and first and second anchor points attached to the first end section, the first and second anchor points spaced apart along a length of the first end section;

where, in operation, the first and second anchor points are located in proximity to a section of tube where the combined back rest and boarding ladder is to be located.

21. The adjustable length transverse brace of claim 20, where an anchor point of the first and second anchor points comprises a loop or a hole.

* * * * *